US010720112B2

(12) United States Patent
Kwon et al.

(10) Patent No.: US 10,720,112 B2
(45) Date of Patent: Jul. 21, 2020

(54) METHOD AND DEVICE FOR CLIPPING A GRAY SCALE LEVEL OF PIXELS DURING THE DIMMING OF THE BACKLIGHT OF A DISPLAY DEVICE

(71) Applicant: LG Display Co., Ltd., Seoul (KR)

(72) Inventors: Kyungjoon Kwon, Paju-si (KR); Cheon Heo, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 385 days.

(21) Appl. No.: 14/918,487

(22) Filed: Oct. 20, 2015

(65) Prior Publication Data

US 2016/0133205 A1 May 12, 2016

(30) Foreign Application Priority Data

Nov. 7, 2014 (KR) ..... 10-2014-0154650

(51) Int. Cl.
*G09G 3/34* (2006.01)

(52) U.S. Cl.
CPC ..... *G09G 3/342* (2013.01); *G09G 2320/029* (2013.01); *G09G 2320/0271* (2013.01);
(Continued)

(58) Field of Classification Search
CPC ..... G09G 3/34; G09G 3/3406; G09G 3/3413; G09G 3/342; G09G 3/3426; G09G 2320/0626; G09G 2320/0633; G09G 2320/064; G09G 2320/0646; G09G 2320/0653
See application file for complete search history.

(56) References Cited

U.S. PATENT DOCUMENTS

2002/0057238 A1* 5/2002 Nitta ..... G09G 3/342 345/87
2008/0074372 A1* 3/2008 Baba ..... G09G 3/3406 345/89
2011/0025592 A1* 2/2011 Botzas ..... G09G 3/3406 345/102

FOREIGN PATENT DOCUMENTS

CN 101170642 A 4/2008
CN 101295486 A 10/2008
(Continued)

OTHER PUBLICATIONS

Chinese First Office Action, Chinese Application No. 201510750956.8, dated Aug. 9, 2017, 13 pages.

*Primary Examiner* — William Boddie
*Assistant Examiner* — Jeffrey Parker
(74) *Attorney, Agent, or Firm* — Fenwick & West LLP

(57) ABSTRACT

The present disclosure provides method and device for dimming the backlight of an LCD. A number of pixels at each grayscale level of an input image is determined. The determined number of pixels at each grayscale level is accumulated to generate an accumulated distribution of the number of pixel and the accumulated distribution is filtered. A threshold grayscale level at which the filtered accumulated distribution exceeds a threshold value is determined. A scaling factor is determined based on the threshold grayscale level. The grayscale level of pixels of the input image having a grayscale level lower than or equal to the threshold grayscale level are up-scaled based on the scaling factor, the grayscale value of pixels of the input image having a grayscale level greater than the threshold grayscale level are set to have a predetermined clipping grayscale level, and the LCD backlight is dimmed based on the scaling factor.

15 Claims, 8 Drawing Sheets

| Gray | Pixel | Count_old | Count_new |
|---|---|---|---|
| 255 | 10000 | 10000 | 0+10000=10000 |
| ... | 0 | 10000 | 10000+10000+...=... |
| 192 | 10000 | 20000 | 630000+20000=650000 |
| ... | 0 | 20000 | 650000+20000+...=... |
| 128 | 10000 | 30000 | 1310000+30000=1340000 |
| ... | 0 | 30000 | 1340000+30000+...=... |
| 64 | 10000 | 40000 | 3830000+40000=3870000 |
| ... | 0 | 40000 | 3870000+40000+...=... |
| 0 | 10000 | 50000 | 6390000+50000=6440000 |

(52) U.S. Cl.
CPC ..... *G09G 2320/0626* (2013.01); *G09G 2320/0646* (2013.01); *G09G 2330/023* (2013.01)

(56) References Cited

FOREIGN PATENT DOCUMENTS

| | | | |
|---|---|---|---|
| CN | 101422031 | A | 4/2009 |
| KR | 10-2015-0039468 | A | 4/2015 |
| WO | WO 2011/108143 | A1 | 9/2011 |

* cited by examiner

| Gray | Pixel | Count |
|---|---|---|
| 255 | 10000 | 0+10000=10000 |
| ··· | 0 | 10000+0=10000 |
| 192 | 10000 | 10000+10000=20000 |
| ··· | 0 | 20000+0=20000 |
| 128 | 10000 | 20000+10000=30000 |
| ··· | 0 | 30000+0=30000 |
| 64 | 10000 | 30000+10000=40000 |
| ··· | 0 | 40000+0=40000 |
| 0 | 10000 | 40000+0=50000 |

| Gray | Pixel | Count |
|---|---|---|
| 255 | 20000 | 0+20000=20000 |
| ... | 0 | 20000+0=20000 |
| 128 | 20000 | 20000+20000=40000 |
| ... | 0 | 40000+0=40000 |
| 0 | 10000 | 40000+10000=50000 |

| Gray | Pixel | Count_old | Count_new |
|---|---|---|---|
| 255 | 10000 | 10000 | 0+10000=10000 |
| … | 0 | 10000 | 10000+10000+…=… |
| 192 | 10000 | 20000 | 630000+20000=650000 |
| … | 0 | 20000 | 650000+20000+…=… |
| 128 | 10000 | 30000 | 1910000+30000=1940000 |
| … | 0 | 30000 | 1940000+30000+…=… |
| 64 | 10000 | 40000 | 3830000+40000=3870000 |
| … | 0 | 40000 | 3870000+40000+…=… |
| 0 | 10000 | 50000 | 6390000+50000=6440000 |

| Gray | Pixel | Count_old | Count_new |
|---|---|---|---|
| 255 | 20000 | 20000 | 0+20000=20000 |
| … | 0 | 20000 | 20000+20000+…=… |
| 128 | 20000 | 40000 | 2540000+40000=2580000 |
| … | 0 | 40000 | 2580000+40000+…=… |
| 0 | 10000 | 50000 | 7660000+50000=7710000 |

METHOD AND DEVICE FOR CLIPPING A GRAY SCALE LEVEL OF PIXELS DURING THE DIMMING OF THE BACKLIGHT OF A DISPLAY DEVICE

This application claims the benefit of Korean Patent Application No. 10-2014-0154650 filed on Nov. 7, 2014, which is incorporated herein by reference for all purposes as if fully set forth herein.

BACKGROUND

Field

This document relates to a method and device for clipping a gray scale level of pixels displayed by a display device during the dimming of the backlight of the display device.

Related Art

An active crystal type liquid crystal display (LCD) device displays images by using a Thin Film Transistor (hereinafter referred to as a "TFT") as a switching device. Since the LCD device is not a spontaneous light emitting device, the LCD device uses a backlight unit to irradiate light onto a liquid crystal display panel. Light sources of the backlight unit and power consumption of an inverter circuit to drive the light sources account for most of the entire power consumption.

In order to reduce power consumption of the backlight unit, a backlight dimming method is widely used. The backlight dimming method may be divided into a local dimming method and a global dimming method, in which the local dimming method includes dividing a display surface into a plurality of blocks and separately controlling backlight brightness of each block, while the global dimming method includes reducing backlight brightness of the entire display surface all together. The local dimming method may improve static contrast by locally controlling brightness of a display surface within a period of one frame, and may reduce power consumption. However, the local dimming method has a drawback in that its algorithm and hardware is very complicated, and the method may only be applied to a direct-type light emitting diode (LED) backlight unit. The global dimming method may improve dynamic contrast and may reduce power consumption. Further, the global dimming method uses an algorithm and hardware that has low complexity, and may be applied to any type of a backlight unit.

The global dimming method includes: a backlight modulation process that reduces power consumption by reducing backlight brightness; and an image compensation process that compensates for reduced backlight brightness by using gray scales of pixel data of an image. In the global dimming method, a gray level of pixel data is increased to compensate for reduced backlight brightness, but there is a limitation in the compensation using gray scales of pixel data. For example, in the case of 8-bit pixel data, the highest gray level of the pixel data is 255, such that the gray scale may not be adjusted beyond that level. Accordingly, a general global dimming method may not express a gray level appropriately due to the highest gray level saturation of pixel data. In order to solve the problem, pixel data having the highest gray level may be clipped in advance from an input image at a predetermined clipping rate, so that the highest backlight brightness may be controlled. The clipped pixel data refer to pixel data having brightness that may not be expressed due to a limitation in the highest gray level values.

The clipped rate is a percentage value obtained by dividing a number of clipped pixels by the total number of pixels of an input image. The general global dimming method may include determining a clipped rate, and then generating a histogram of the input image to determine a gray level, so that based on the determined gray level, pixel data having gray scales above that level may be clipped from the input image.

FIG. 1 is an image sample, and FIG. 2 illustrates a histogram of the image in FIG. 1, in which an x-axis represents gray scale values, and a y-axis represents accumulated pixel values.

In the histogram, a number of pixels is counted starting from the highest gray scale, and the counting is repeated by reducing a gray scale in the histogram until the count exceeds a predetermined threshold. A gray scale previous to a gray scale that is above the threshold is determined to be a frame max. Once the frame max is determined, a frame gain (also referred to as scaling factor herein) is calculated by dividing the highest gray scale value, e.g., 255, by the frame max. By multiplying pixel data and the frame gain, pixel data may be modulated such that brightness of pixels may be increased, and the highest brightness of a backlight unit may be reduced, thereby reducing power consumption.

In order to obtain the frame max, a method of accumulating counts includes counting a number of pixels in a histogram of FIG. 2 by reducing a gray scale starting from a bin having the highest gray scale, until an accumulated count exceeds a specific threshold. The method of accumulating counts includes merely accumulating a number of pixels accumulated for each gray scale. For example, an accumulated count of gray scale N may be calculated by the method of accumulating counts as follows: $C_N=C_{N+1}+P_N$, in which $P_N$ (being a positive integer) is a number of pixels of gray scale N, $C_{N+1}$ is an accumulated count of gray scale N+1, and $C_N$ is an accumulated count of gray scale N.

TABLE 1

| Gray scale (N) | Number of pixels ($P_N$) | Method of accumulating counts ($C_N = C_{N+1} + P_N$) |
|---|---|---|
| 255 | 584 | 584 |
| 254 | 0 | 584 + 0 = 584 |
| 253 | 1 | 584 + 1 = 585 |
| 252 | 4 | 585 + 4 = 589 |
| 251 | 1 | 589 + 1 = 590 |
| . . . | . . . | . . . |
| | | Accumulating counts until an accumulated number of pixels exceeds a threshold |

In the histogram of FIG. 2, gray scales above the frame max are clipped pixel data. In the histogram, an area of the histogram above the frame max is a number of clipped pixel data.

If there are a large number of clipped pixels, there may be more clipping artifacts felt by an observer, which leads to deterioration in image quality. The clipping artifact may be calculated as an annoyance level proposed by the Applicants of the present disclosure in Korean Patent Publication No. 10-2015-0039468 (Apr. 10, 2015).

If a frame gain is too high when modulating pixel data, a number of clipped pixel data is increased, such that an observer may feel deterioration in image quality. A degree of deterioration in image quality felt by an observer due to data clipping may vary depending on gray scales. For example, in the case where a frame max is set to be 200, a frame gain is multiplied by each of gray scales 255 and 201 of a clipped original image, and then the gray scales 255 and 201 are changed to 255. Once backlight brightness is reduced by a value of redundant brightness that is obtained by multiplying a frame gain and pixel data, thereby reducing power consumption, gray scales 201 and 255 are all represented by a gray scale of 200. Accordingly, deterioration in image quality of an original image having the gray scale of 255 seems more severe than deterioration in image quality of an original image having the gray scale of 201.

In order to solve the above problem, the inventors of the present disclosure have proposed a method of adjusting a frame gain in consideration of both a depth factor and a width factor of an annoyance level in Korean Patent Application No. 10-2013-0118088 (Oct. 2, 2013), in which the depth factor is an indication of a degree of image quality deterioration felt by an observer due to a clipping artifact, and the width factor is an indication of a gray scale at which an observer may feel image quality deterioration due to a clipping artifact. However, the method requires additional memory capacity and a large amount of operations.

In the method of accumulating counts, the width factor of an annoyance level may be estimated, but the depth factor of an annoyance level may not be obtained, which will be described below with reference to FIGS. 3 and 4. Images in FIGS. 3 and 4 have different gray scale distributions.

In the case where a threshold is set to be 25,000, a gray scale that is above the threshold is 128 in images of FIGS. 3 and 4. In the image of FIG. 3, a clipped amount of pixel data may be calculated as follows: $(255-128)*\frac{1}{5}+(192-128)*\frac{1}{5}=38.2$, where $\frac{1}{5}$ represents an area of pixels having gray scales of 255 and 192 in the image. By contrast, in the image of FIG. 4, a clipped amount of pixel data may be calculated as follows: $(255-128)*\frac{2}{5}=50.8$, where $\frac{2}{5}$ represents an area ratio of pixels having a gray scale of 255 in an image. Accordingly, a clipped amount is greater in the image of FIG. 4 than in the image of FIG. 3, such that deterioration in image quality is more severe in the image of FIG. 4 than in the image of FIG. 3.

Accordingly, in the method of accumulating counts, a frame max and a frame gain are the same in the image of FIG. 4 and in the image of FIG. 3, leading to different degrees of deterioration in image quality. However, In order to reduce such image quality deterioration, if a clipped amount of pixel data is reduced by increasing a threshold, an effect of improving power consumption is reduced.

SUMMARY

The present disclosure provides a data clipping method and device, in which deterioration in image quality felt by an observer due to clipped pixel data may be estimated more accurately, so that a frame gain may be adjusted according to an input image reducing deterioration in image quality.

In one general aspect, a number of pixels at each grayscale level of an input image to an LCD is determined. The determined number of pixels at each grayscale level is accumulated to generate an accumulated distribution of the number of pixel at each grayscale level. The accumulated distribution of the number of pixels at each grayscale level is filtered to generate a filtered accumulated distribution of the number of pixels. A threshold grayscale level at which the filtered accumulated distribution of the number of pixels exceeds a threshold value is determined, and a scaling factor is determined based on the determined threshold grayscale level. The grayscale level of pixels of the input image having a grayscale level lower than or equal to the determined threshold grayscale level are up-scaled based on the scaling factor, the grayscale value of pixels of the input image having a grayscale level greater than the threshold grayscale level are set to have a predetermined clipping grayscale level, and a backlight of the LCD is dimmed based on the scaling factor.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
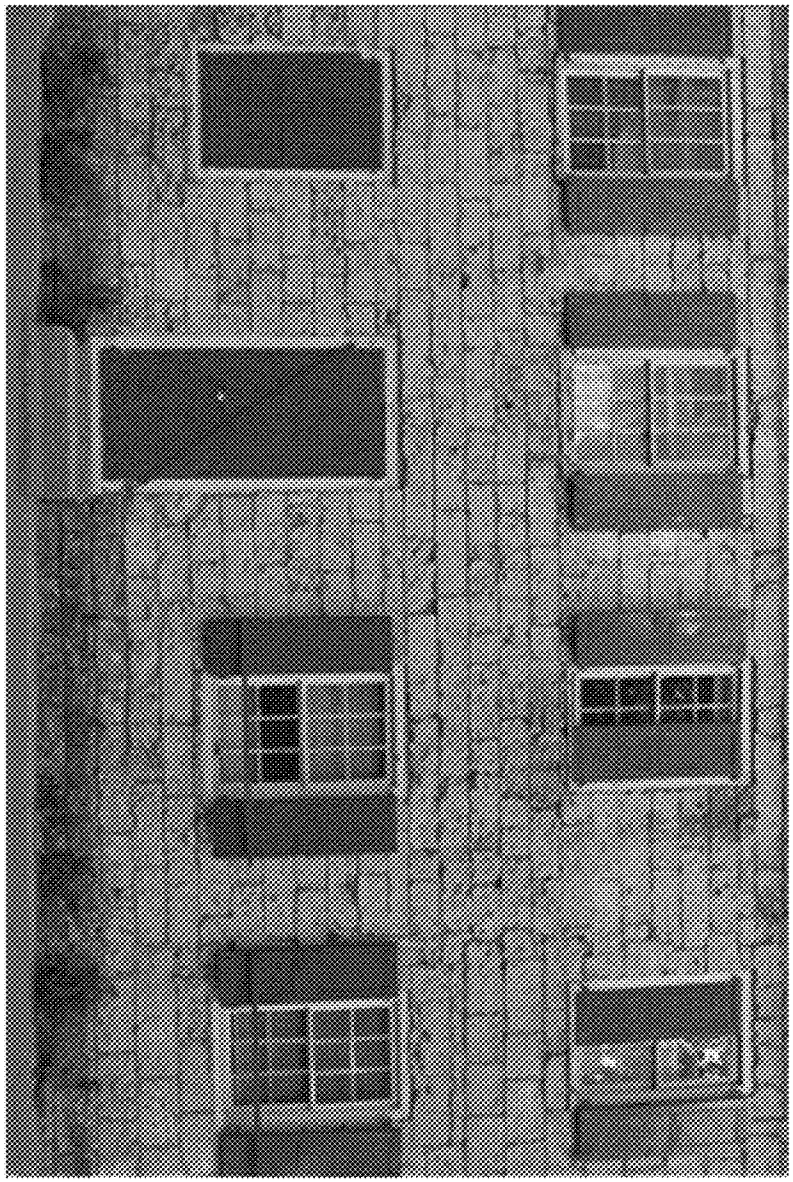
FIG. 1 (RELATED ART)
FIG. 1 is a sample of an image to obtain a histogram.

Hereinafter, exemplary embodiments of the present invention will be described with reference to the drawings. Throughout the specification, like reference numerals denote substantially like components.

The data clipping device and method according to an exemplary embodiment of the present disclosure provides a method of accumulating counts of a histogram to estimate a clipping artifact felt by an observer due to clipped pixel data. Further, based on the clipping artifact estimated by the method of accumulating a secondary count of a histogram, the display device of the present disclosure may adjust a frame gain according to characteristics of an image, so that a clipping artifact may be reduced and power consumption of a backlight unit may be further reduced.

In the present disclosure, a histogram of an input image is prepared, in which when an accumulated number of pixels is counted by reducing gray scales starting from the highest-level gray scale of a histogram, the method of the present disclosure includes not only accumulating each bin of a histogram, but also adding an accumulated count of higher-level bins of the histogram. The bin refers to each gray scale of a histogram. Hereinafter, the above method of accumulating counts will be referred to as a "method of accumulating a secondary count". In the method of accumulating a secondary count, by sharply changing an accumulated count in an accumulated count direction, it may be identified that as a bin gets smaller than a frame max, clipping artifacts becomes more severe.

The method of accumulating a secondary count with respect to the image in FIG. 1 is shown in Table 2. In the method of accumulating a secondary count according to the present disclosure, by adding an accumulated count of gray scale N to an accumulated count of gray scale N−1 that is previously calculated, an accumulated count of gray scale N may be calculated as follows: $C_N=C_{N+1}+P_N$, in which $P_N$ is a number of pixels of gray scale N, $C_{N+1}$ is an accumulated count of gray scale N+1, and $C_N$ is an accumulated count of gray scale N. A secondary accumulated count of gray scale N may be calculated as follows: $D_N=D_{N+1}+C_N$.

TABLE 2

| Gray scale (N) | Number of pixels ($P_N$) | Method of accumulating counts ($C_N = C_{N+1} + P_N$) | Method of accumulating a secondary count according to the present disclosure ($D_N = D_{N+1} + C_N$) |
|---|---|---|---|
| 255 | 584 | 584 | 584 |
| 254 | 0 | 584 + 0 = 584 | 584 + 584 = 1168 |
| 253 | 1 | 584 + 1 = 585 | 1168 + 585 = 1753 |
| 252 | 4 | 585 + 4 = 589 | 1753 + 589 = 2342 |
| 251 | 1 | 589 + 1 = 590 | 2342 + 590 = 2932 |
| . . . | . . . | . . . | . . . |
| | | Accumulating counts until an accumulated number of pixels exceeds a threshold | Accumulating counts until an accumulated number of pixels exceeds a threshold |

Figure 3:
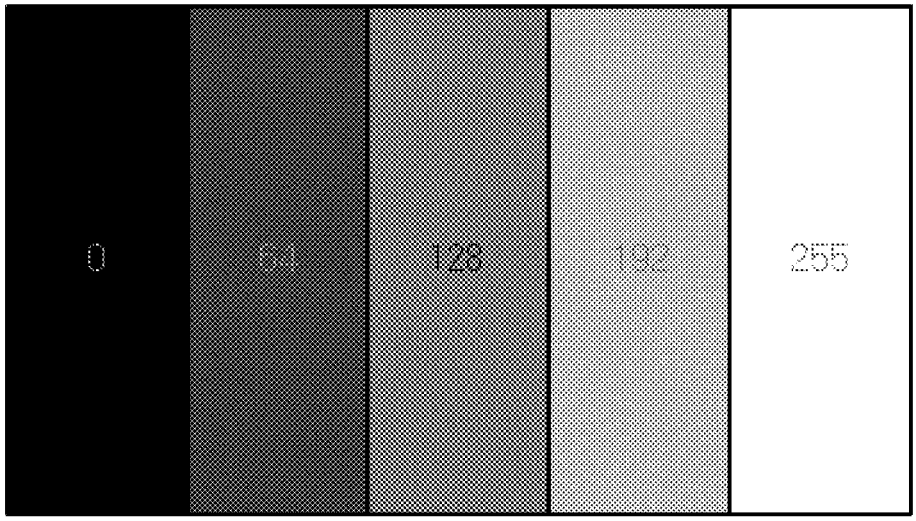
FIG. 3 (RELATED ART)
FIGS. 3 and 4 are diagrams illustrating a method of accumulating counts.
Figure 4:
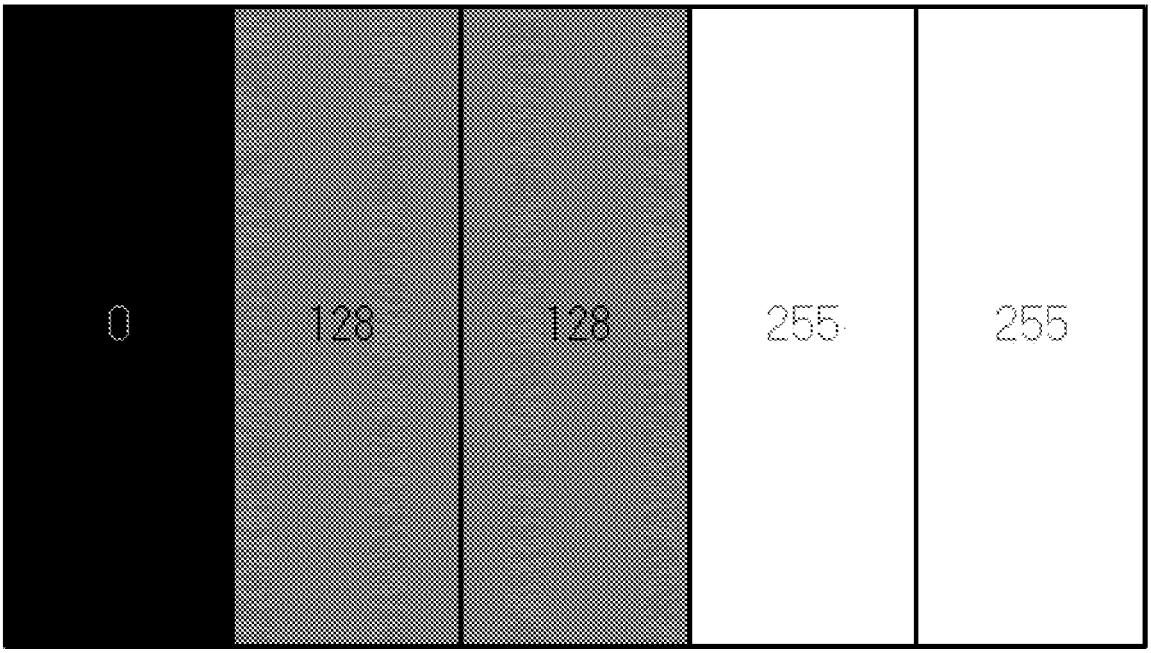
FIG. 4 (RELATED ART)
Figure 5:
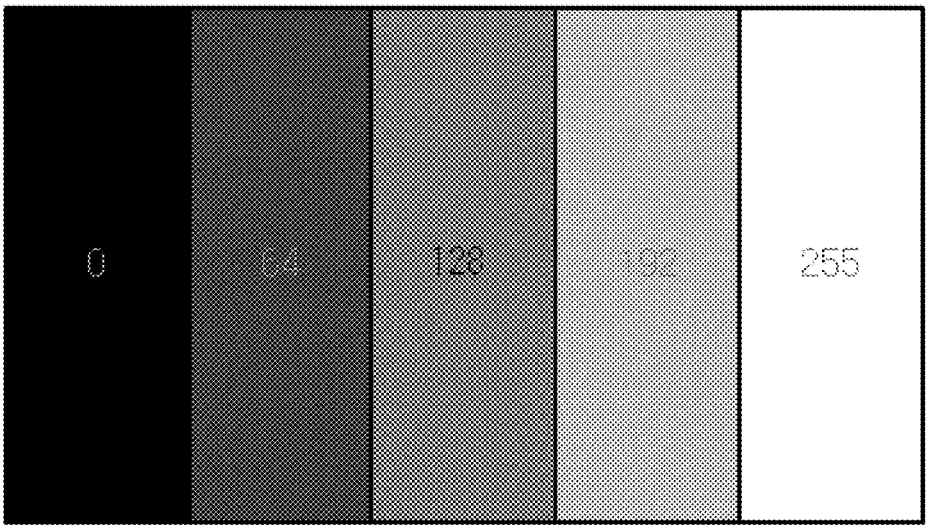
FIGS. 5 and 6 are diagrams illustrating a method of accumulating a secondary count according to an exemplary embodiment of the present disclosure.
Figure 6:
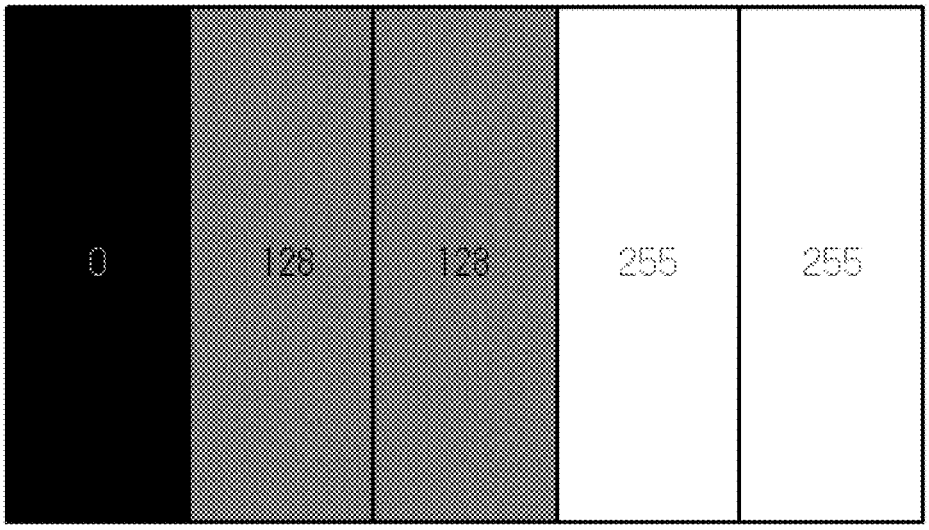

In order to show an effect produced by the method of accumulating a secondary count according to the present disclosure, FIGS. 5 and 6 illustrate a result obtained by applying the method of accumulating a secondary count to the image in FIG. 3 or in FIG. 4. Referring to FIGS. 5 and 6, Count_old is a result of calculation according to a method of accumulating counts ($C_N=C_{N+1}+P_N$ in Table 2), and Count_new is a result of calculation according to the method of accumulating a secondary count of the present disclosure ($D_N=D_{N+1}+C_N$ in Table 2).

In the method of accumulating a secondary count according to the present disclosure, an accumulated count is significantly increased as a bin of a histogram is changed, such that the threshold for the secondary count is set to a higher value. In the case where a threshold is set to be 1,500,000, a gray scale above the threshold is 149 in the image of FIG. 5 (same as FIG. 3). A clipped amount of pixel data in the image of FIG. 5 may be calculated as follows: (255−149)*⅕+(192−149)*⅕=29.8, in which ⅕ represents an area of pixels having gray scales above 149, i.e. gray scales of 255 and 192. A frame max is a gray scale previous to a gray scale that is above the threshold. Accordingly, in the image of FIG. 5, a frame max is 148, such that pixel data above the gray scale of 148 are clipped. With a frame gain being 255/frame max, the frame gain may be calculated as follows: 255/148=1.7. When the image in FIG. 5 is modulated, pixel data may be modulated by multiplying pixel data and the frame gain, such that brightness of pixels may be increased, and the highest brightness of a backlight unit may be reduced, thereby reducing power consumption. A value of data modulated by multiplying the frame gain is saturated to the highest gray scale value that exceeds 255, such that the value is replaced with 255.

In the image of FIG. 6 (same as FIG. 4), a gray scale above the threshold of 1,500,000 is 181. A clipped amount of pixel data in the image of FIG. 6 may be calculated as follows: (255−181)*⅖=29.6, in which ⅖ represents an area ration of pixels having gray scales above 181 in an image. A frame max is a gray scale previous to a gray scale that is above the threshold. Accordingly, in the image of FIG. 6, a frame max is 181, such that pixel data above a gray scale of 181 are clipped. The frame gain may be calculated as follows: 255/181=1.4. When the image in FIG. 6 is modulated, pixel data may be modulated by multiplying pixel data and the frame gain, such that brightness of pixels may be increased, and the highest brightness of a backlight unit may be reduced, thereby reducing power consumption. A value of data modulated by multiplying the frame gain is saturated to the highest-level gray scale that exceeds 255, such that the value is replaced with 255.

In the method of accumulating a secondary count according to the present disclosure, a clipping artifact level, i.e., an annoyance level may be more accurately identified according to images. In the method for accumulating counts, a clipping artifact level in the images of FIGS. 3 and 4 may not be identified by using only the method of accumulating counts. However, according to the present disclosure, the method of accumulating a secondary count may identify a clipping artifact level by differently calculating a frame max according to the images in FIGS. 5 and 6. Further, the method of accumulating a secondary count may optimize a frame gain according to images while maintaining a clipping artifact level, such that an effect of improving power consumption may be enhanced without deterioration in image quality felt by an observer.

Figure 7:
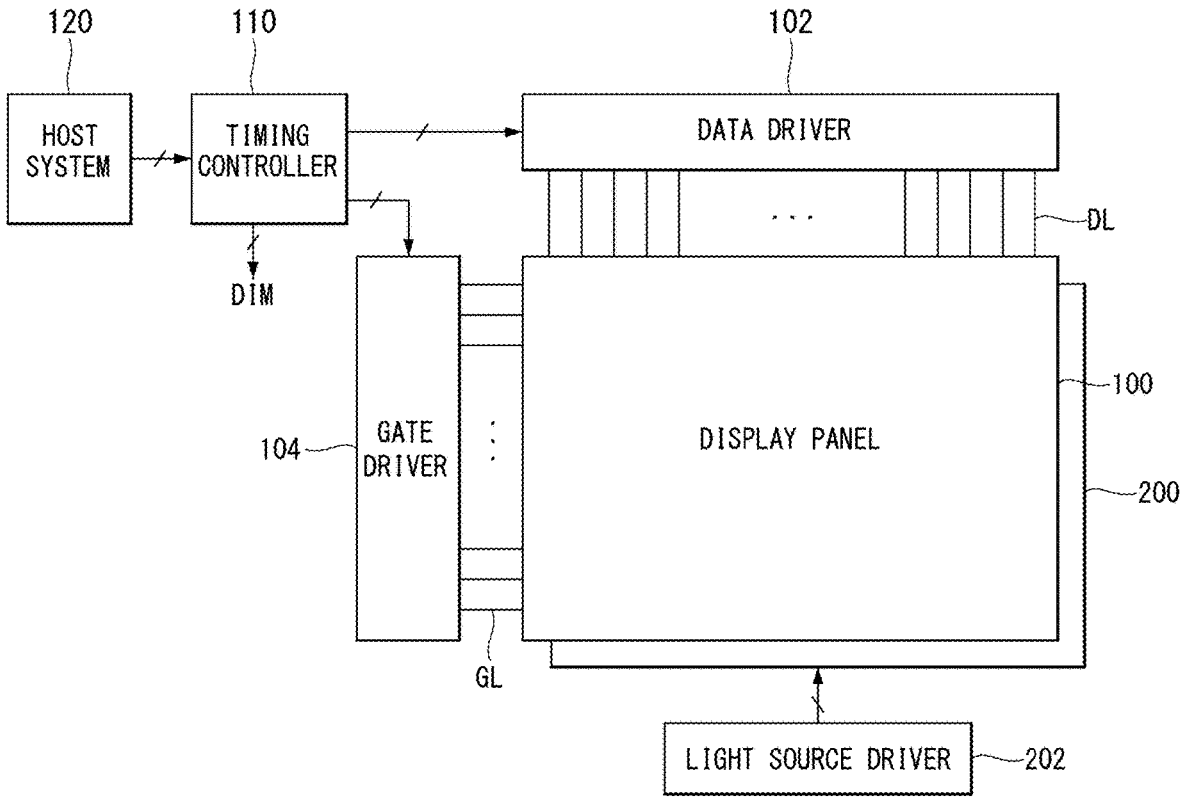
FIG. 7 is a diagram illustrating a display device according to an exemplary embodiment of the present disclosure.
Figure 8:
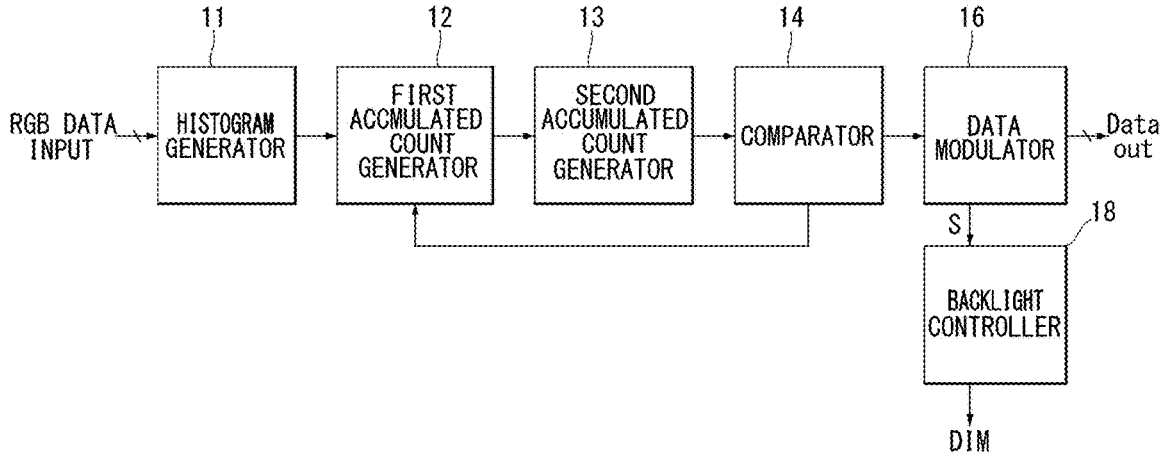
FIG. 8 is a diagram illustrating a data clipping device.

FIG. 7 is a diagram illustrating a display device according to an exemplary embodiment of the present disclosure, and FIG. 8 is a diagram illustrating a data clipping device.

Referring to FIGS. 7 and 8, the display device according to the present disclosure includes a display panel 10, a display panel driver, a backlight unit 200, a light source driver 202, and the like.

A pixel array of the display panel 100 includes data lines (DL), gate lines (GL, or scan lines) that intersect the data lines, and pixels arranged in a matrix form, so as to display an input image.

Each of the pixels includes a liquid crystal cell, a storage capacity (Cst), a Thin-Film Transistor (TFT), and the like. The liquid crystal cell uses liquid crystal molecules driven by an electric field generated between a pixel electrode and a common electrode to which a common voltage is applied, to delay the phase of light, thereby adjusting transmissivity according to data. The storage capacitor maintains the voltage of the liquid crystal cell for a period of one frame. The TFT is turned on according to a gate pulse from the gate lines (GL) to supply a data voltage from the data lines to the pixel electrode of the liquid crystal cell.

The display panel 100 may be driven by any known liquid crystal mode, such as a Twisted Nematic (TN) mode, a Vertical Alignment (VA) mode, an In Plane Switching (IPS) mode, a Fringe Field Switching (FFS) mode, and the like. The liquid crystal display (LCD) device may be implemented in various forms, such as a transmissive LCD, a semi-transmissive LCD, a reflective LCD, and the like. The tansmissive LCD or a semi-transmissive LCD includes the backlight unit 200 and the light source driver 202.

The backlight unit 200 may be configured to be an edge type backlight unit or a direct type backlight unit. The backlight unit 200 is disposed under a rear surface of the display panel 10 to irradiate light onto the display panel 100. The light source driver 202 supplies an electric current to light sources of the backlight unit 200, so that the light sources may emit light. The light source driver 202 adjusts brightness of the light sources by controlling an electric current applied to the light sources according to a dimming signal (DIM) from a backlight controller 18 illustrated in FIG. 8. The light source driver 202 may adjust brightness of the light sources by controlling Pulse Width Modulation in which a pulse width is modulated according to the dimming signal (DIM). The light sources may be Light Emitting Diodes (LEDs).

The display panel driver writes pixel data to pixels of the display panel 100. The display panel driver includes a data driver 102, a gate driver 104, a timing controller 110, and the like.

The data driver 102 generates data voltages by converting modulated digital video data received from the timing controller 110 into a gamma compensation voltage, and supplies the generated data voltages to the data liens (DL) of the display panel 100. The gate driver 104 supplies a gate pulse, which is synchronized with the data voltages supplied to the data lines (DL), to the gate lines (GL) under the control of the timing controller 130, and sequentially shifts the gate pulse.

The timing controller 110 transmits digital video data of an input image received from a host system 120 to the data driver 102. The timing controller 110 controls the timing of operations of the data driver 102 and the gate driver 104 by using a timing signal, such as a vertical synchronizing signal, a horizontal synchronizing signal, a data enable signal, a main clock, and the like, which is synchronized with digital video data and received from the host system 120. The timing controller 110 modulates pixel data of an input image based on a frame gain by using a data clipping device illustrated in FIG. 8, and generates a dimming signal (DIM) to control the brightness of a backlight unit.

The host system 120 may be any one of a television (TV) system, a set-top box, a navigation system, a DVD player, a blue-ray player, a personal computer (PC), a home theater system, and a phone system. The host system 120 may adjust a resolution of an input image appropriately according to a resolution of the display panel 100 by using a scaler, and transmits the adjusted resolution to the timing controller 110 along with the timing signal.

The data clipping device may be mounted in a data clipping device. The data clipping device clips pixel data having a high-level gray scale in a histogram of an input image. Further, the data clipping device modulates the pixel data by using a frame gain (S) and controls a dimming signal.

As illustrated in FIG. 8, the data clipping device includes a histogram generator 11, a first accumulated count generator 12, a second accumulated count generator 13, a comparator 14, a data modulator 16, a backlight controller 18.

Figure 2:
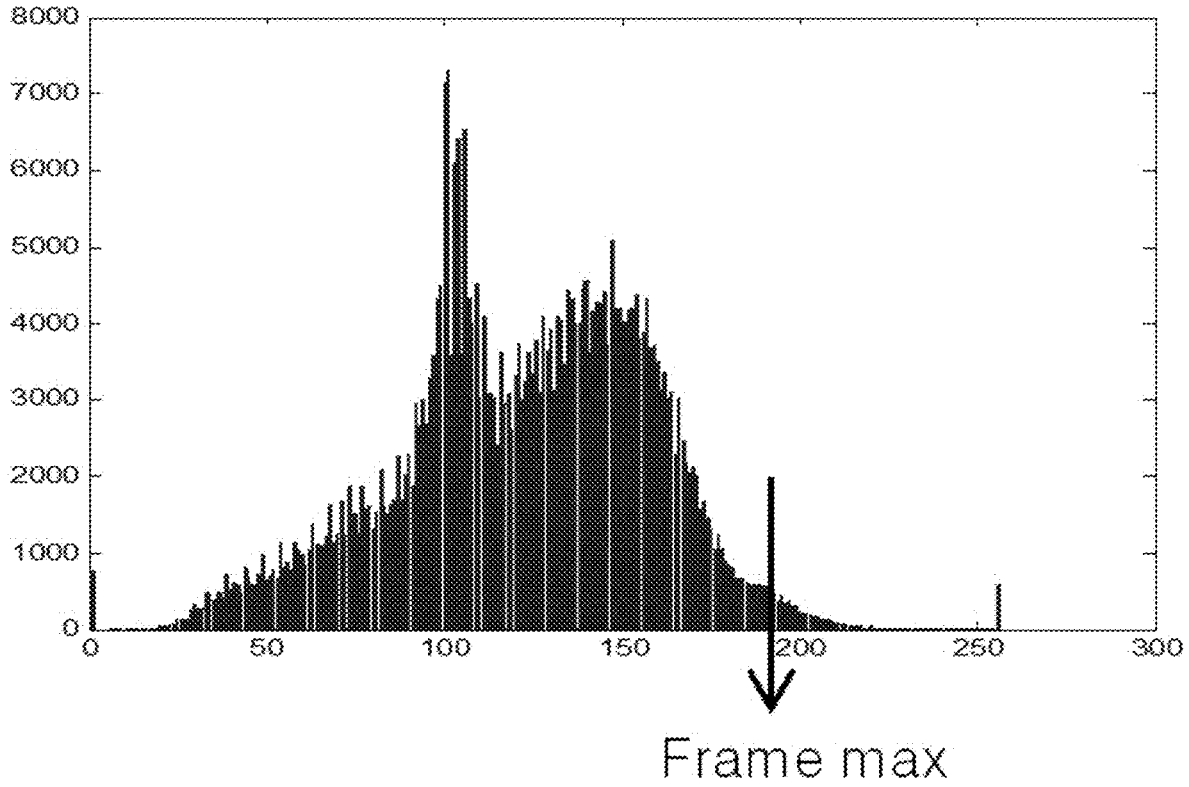
FIG. 2 (RELATED ART)
FIG. 2 is a histogram of the image in FIG. 1.

Referring to FIG. 8, the histogram generator 11 generates a histogram of an input image. The histogram represents an accumulated number of pixels for each gray scale as illustrated in FIGS. 1 and 2.

A first accumulated count generator 12 calculates, by using a method of accumulating counts, a primary accumulated count of gray scale N as follows: $C_N=C_{N+1}+P_N$, in which N represents a number of pixels of gray scale N, and Np represents a number of pixels of gray scale N−1 in a histogram.

The second accumulated count generator 13 filters the primary accumulated count of gray scale levels. In some embodiments, the second accumulated count generator 13 uses a low pass filter to filter the primary accumulated count of gray scale levels. For instance, the second accumulated count generator 13 may accumulate the primary accumulated count ($C_N$) of gray scale N, so as to output a secondary accumulated count ($D_N=D_{N+1}+C_N$) of gray scale N. In other words, accumulation or integration may be a form of low pass filtering of the primary accumulated count of gray scale levels. As a result, the effect of a particular primary accumulated count becomes less pronounced because its effect on the display will be in the context of its incremental change to the secondary accumulated count up to that point of gray scale. In other embodiments, different forms of filtering other than accumulation or integration may be used to make the effect of a particular primary accumulated count becomes less pronounced. For example, the second accumulated count generator 13 may use a digital filter, an analog filter, an integrator, or an accumulator.

The comparator 14 stores a specific threshold. The comparator 14 compares the secondary accumulated count input from the second accumulated count generator 13 with a threshold. In response to the secondary accumulated count (DN) being greater than the threshold, the comparator 14 transmits an Enable signal to the first accumulated count generator 12. Upon receiving the Enable signal from the comparator 14, the first accumulated count generator 12 reduces a gray scale of a histogram and continues accumulation of counts at the gray scale level. In response to the secondary accumulated count ($D_N$) being greater than the threshold, the comparator 14 outputs gray scale N−1 of a secondary accumulated count stored previously to the $D_N$ as a frame max (frame max in FIG. 2).

The data modulator 16 calculates a frame gain (S) as follows: S=255/frame max. Further, the data modulator 16 modulates pixel data by multiplying pixel data of an input image and the frame gain (S). The modulated pixel data may be transmitted to the data driver 102 by the timing controller 110.

The backlight driver 18 controls a dimming signal (DIM) based on the frame gain (S) calculated by the data modulator 16 to reduce backlight brightness by 1/S times or lower. Accordingly, the backlight brightness may be controlled according to a reciprocal number of the frame gain (S).

Figure 9:
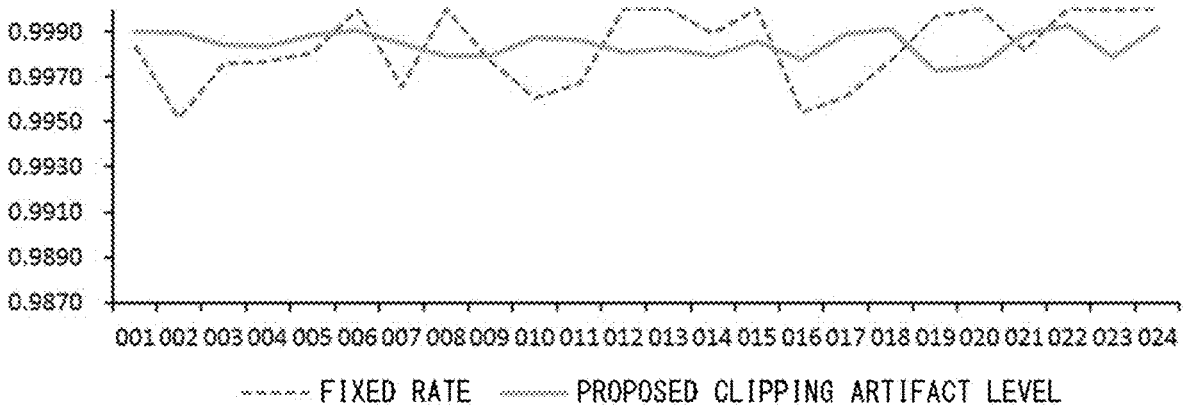
FIG. 9 is a diagram illustrating a result of experiment in which a proposed clipping artifact level (or an annoyance level) of a display device according to an exemplary embodiment of the present disclosure is compared with a fixed ratio.

FIG. 9 is a diagram illustrating a result of experiment in which a proposed clipping artifact level (or an annoyance level) of a display device according to an exemplary embodiment of the present disclosure is compared with a fixed ratio. The result of experiment illustrated in FIG. 9 shows a clipping artifact level of 24 Kodak sample images most widely used for evaluation of image quality. In FIG. 9, an x-axis represents an image sample number, a y-axis represents an annoyance level that indicates a clipping artifact level. In the experiment, the inventors of the present disclosure controlled a fixed ratio and a proposed threshold so that efficiency in reducing average power consumption may be adjusted to be 20%, and modulated the threshold by using a Structural Similarity (SSIM) index, so as to measure an annoyance level of each image. As shown in the experiment in FIG. 9, the data clipping method according to the present disclosure enables an annoyance level to be much more uniform than in the method for accumulating counts. In FIG. 9, the lower the annoyance level is, more severe deterioration in image quality may be felt by an observer. In the method for accumulating counts, an annoyance level is changed in a range between 0.9950 and 0.9990, such that deterioration in image quality felt by an observer is significantly changed. In the method for accumulating counts, a threshold is fixed to the worst case of the annoyance level, such that it is difficult to improve an effect of reducing power consumption. By contrast, in the present disclosure, a clipping artifact level is further improved than that of the method for accumulating counts, and a frame gain is adjusted in a range that may not cause an observer to feel deterioration in image quality according to images, thereby further improving efficiency in reducing power consumption without deterioration in image quality.

As described above, the data clipping method and device according to the present disclosure may identify a clipping artifact level according to images by using a secondary accumulated count, so that a frame gain may be adjusted according to characteristics of images. As a result, the display device of the present disclosure may accurately estimate deterioration in image quality felt by an observer due to clipped data, so that a frame gain may be adjusted according to an input image without deterioration in image quality.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for dimming the backlight of a liquid crystal display (LCD), the method comprising:

determining a number of pixels at each grayscale level of an input image to the LCD;

generating a first distribution by, for each grayscale level:

determining a first value by adding:

(a) the determined number of pixels in the input image corresponding to the grayscale level, and (b) the determined number of pixels in the input image at each grayscale level higher than the grayscale level;

generating a second distribution based on the first distribution by for each grayscale level:

determining a second value by adding:

(a) the determined first value corresponding to the grayscale level in the first distribution, and (b) the determined first value corresponding to every grayscale level higher than the grayscale level in the first distribution, including grayscale levels higher than the grayscale level with zero pixels in the input image determining a threshold grayscale level at which the second distribution exceeds a threshold value;

determining a scaling factor based on the determined threshold grayscale level;

up-scaling the grayscale level of pixels of the input image having a grayscale level lower than or equal to the determined threshold grayscale level based on the scaling factor;

setting the grayscale value of pixels of the input image having a grayscale level greater than the threshold grayscale level to have a predetermined clipping grayscale level; and dimming a backlight of the LCD based on the scaling factor.

2. The method of claim 1, wherein the scaling factor is inversely proportional to the threshold grayscale level.

3. The method of claim 2, wherein the scaling factor is directly proportional to a maximum grayscale level of the LCD.

4. The method of claim 1, wherein setting the grayscale value of pixels having a grayscale level greater than the threshold grayscale level to have a predetermined clipping grayscale level comprises:

setting the grayscale value of pixels having a gray scale level greater than the threshold grayscale level to have a grayscale level equal to a maximum grayscale level of the LCD.

5. The method of claim 1, wherein the backlight is dimmed by a factor inversely proportional to the scaling factor.

6. The method of claim 1, wherein the determination of the first value at each grayscale level starts from a maximum grayscale level of the LCD.

7. A liquid crystal display (LCD) comprising:

a histogram generator configured to determine a number of pixels at each grayscale level of an input image of the LCD;

first accumulator configured to receive the number of pixels at each grayscale level from the histogram generator, and to generate a first distribution by, for each grayscale level:

determining a first value by adding:

(a) the received number of pixels in the input image corresponding to the grayscale level, and (b) with the received number of pixels in the input image at each grayscale level higher than the grayscale level;

a second accumulator configured to receive the first distribution from the first accumulator, and to generate a second distribution based on the first distribution by, for each grayscale level:

determining a second value by adding:

(a) the determined first value corresponding to the grayscale level in the first distribution, and (b) the determined first value corresponding to every grayscale level higher than the grayscale level in the first distribution, including grayscale levels higher than the grayscale level with zero pixels in the input image;

a comparator configured to receive the second distribution from the second accumulator, compare the second distribution to a threshold value, and determine a threshold grayscale level at which the second distribution exceeds the threshold value;

a data modulator configured to receive the threshold grayscale level from the comparator, to determine a scaling factor based on the determined threshold grayscale level, to up-scale the grayscale level of pixels of the input image having a grayscale level lower than or equal to the determined threshold grayscale level based on the scaling factor, and to set the grayscale value of pixels of the input image having a grayscale level greater than the threshold grayscale level to have a predetermined clipping grayscale level; and a backlight controller configured to receive the scaling factor from the data modulator, and dim the backlight of the LCD based on the scaling factor.

8. The LCD of claim 7, wherein the scaling factor is inversely proportional to the threshold grayscale level.

9. The LCD of claim 8, wherein the scaling factor is directly proportional to a maximum grayscale level of the LCD.

10. The LCD of claim 7, setting the grayscale value of pixels having a grayscale level greater than the threshold grayscale level to have a predetermined clipping grayscale level comprises:

setting the grayscale value of pixels having a gray scale level greater than the threshold grayscale level to have a grayscale level equal to a maximum grayscale level of the LCD.

11. The LCD of claim 7, wherein the backlight is dimmed by a factor inversely proportional to the scaling factor.

12. The LCD of claim 7, wherein the determination of the first value at each grayscale level starts from a maximum grayscale level of the LCD.

13. A display driver circuit for driving a display panel of a liquid crystal display (LCD) and a backlight of the LCD, the display driver comprising:

a histogram generator configured to determine a number of pixels at each grayscale level of an input image of the LCD;

a first accumulator configured to receive the number of pixels at each gray scale level from the histogram generator, and to generate a first distribution by, for each grayscale level:

determining a first value by adding:

(a) the received number of pixels in the input image corresponding to the grayscale level, and (b) the received number of pixels in the input image at each grayscale level higher than the grayscale level;

a second accumulator configured to receive the first distribution from the first accumulator, and to generate a second distribution based on the first distribution by, for each grayscale level:

determining a second value by adding:

(a) the determined first value corresponding to the grayscale level in the first distribution, and (b) the determined first value corresponding to every grayscale level higher than the grayscale level in the first distribution, including grayscale levels higher than the grayscale level with zero pixels in the input image;

a comparator configured to receive the second distribution from the second accumulator, compare the second distribution to a threshold value, and determine a threshold grayscale level at which the second distribution exceeds the threshold value;

a data modulator configured to receive the threshold grayscale level from the comparator, to determine a scaling factor based on the determined threshold grayscale level, and to up-scale the grayscale level of pixels of the input image having a grayscale level lower than or equal to the determined threshold grayscale level based on the scaling factor, and set the grayscale value of pixels of the input image having a grayscale level greater than the threshold grayscale level to have a predetermined clipping grayscale level; and a backlight controller configured to receive the scaling factor from the data modulator, and dim the backlight of the LCD based on the scaling factor.

14. The display driver circuit of claim 13, wherein the scaling factor is inversely proportional to the threshold grayscale level.

15. The display driver circuit of claim 13, wherein the backlight is dimmed by a factor inversely proportional to the scaling factor.

* * * * *